US005533874A

United States Patent [19]

Hauser

[11] Patent Number: 5,533,874

[45] Date of Patent: Jul. 9, 1996

[54] STAND FOR A PUMP

[75] Inventor: Erwin Hauser, Emmendingen-Kollmarsreute, Germany

[73] Assignee: KNF Neuberger GmbH, Freiburg-Munzingen, Germany

[21] Appl. No.: 332,019

[22] Filed: Oct. 31, 1994

[30] Foreign Application Priority Data

Nov. 3, 1993 [DE] Germany ..... 93 16 757 U

[51] Int. Cl.[6] ..... F04B 17/00; F16M 1/00

[52] U.S. Cl. ..... 417/360; 248/678

[58] Field of Search ..... 417/313, 360, 417/361; 248/672, 676, 678, 670

[56] References Cited

U.S. PATENT DOCUMENTS

| | | | |
|---|---|---|---|
| 2,064,751 | 12/1936 | Hussman | 248/678 |
| 3,036,375 | 5/1962 | Schlosser et al. | 248/678 |
| 3,493,201 | 2/1970 | Marran | 248/678 |
| 4,354,655 | 10/1982 | Hengst | 248/676 |
| 4,502,656 | 3/1985 | Zeitler | 248/678 |
| 4,917,581 | 4/1990 | Richardson et al. | 248/678 |
| 5,011,379 | 4/1991 | Mashimoto | 417/360 |
| 5,040,953 | 8/1991 | Tinsler | 417/360 |
| 5,067,685 | 11/1991 | Johnston, Jr. | 248/676 |
| 5,085,396 | 2/1992 | Mansson | 248/676 |

*Primary Examiner*—Peter Korytnyk

*Attorney, Agent, or Firm*—Panitch Schwarze Jacobs & Nadel

[57] ABSTRACT

A pump stand (1) has a base plate (2) for mounting thereon a pump (3) and at least one of a control unit (6) and a vacuum controller (7). The pump stand (1) has for this purpose a plurality of push-in or snap-in connections (5) enabling pump components or accessory units, particularly the pump (3) itself, to be simply exchanged. By this means a pump stand (1) of straightforward arrangement ensues, which provides a large number of possibilities for variation and can be simply combined with pumps of different type or different output.

10 Claims, 2 Drawing Sheets

STAND FOR A PUMP

FIELD OF THE INVENTION

The invention relates to a pump stand for mounting a pump and at least one accessory unit, such as a pump control unit, on a supporting plate.

BACKGROUND OF THE INVENTION

Pumps accommodated in a substantially closed, e.g. cuboid, container are already known which also house accessory units of the pump. The advantage of such known pump stands consists essentially in that they are accommodated in a self-contained or closable, case-like enclosure together with the associated accessory units. Among the disadvantages displayed by this type of pump stand with closed container is that such pump stands cannot be easily adapted to the different requirements of the users. They are therefore often equipped with numerous parts complementing the pump of the pump stand, such as vacuum controller, control unit, trap or the like, even though these parts are not needed in a particular instance. Accordingly, such substantially box-like pump stand containers are relatively elaborate and costly and not very adaptable to varied requirements.

Pump stands are also already known which carry the pump in an open state on a base plate to be selected and have accessory units for the pump simply mounted around the latter. The advantage of this type is the simplicity with which the respective accessory unit(s) required can be selected and added. Even relatively large accessory units, such as traps for exhaust vapor condensate for example, may also be retrofitted to the base plate. Major drawbacks of such an open pump stand include, inter alia:

Control parts are, as a rule, only associated with the respective accessory unit, so that any different, separate control units must be housed on a "home-made board". These then also include various, different electrical, hydraulic or pneumatic connecting lines. A drawback in this connection is that these connecting lines often lie open on the base plate or must be fixed there in an open state. In practice, they are also in the way during operation of the pump stand, and they lack the protection they would have in the above-mentioned, container-like pump stand.

SUMMARY OF THE INVENTION

An object underlying the invention is therefore particularly to provide a pump stand which substantially avoids or greatly reduces the respective drawbacks of the known pump stands, while retaining significant features embodying the respective advantages of the above-mentioned known pump stands. This includes, on the one hand, that accessory units selected by the user can be easily mounted on the pump stand (and removed again, if necessary); and that it be relatively easy to alter, add and exchange parts of the pump stand. On the other hand, it should be possible for the pump stand also to be assembled and operated as a substantially closed system, for instance with a control unit in which all pneumatic, hydraulic and electrical interconnections are collected.

The above and other objects are accomplished according to the invention with a pump stand which essentially has a base plate provided with a plurality of push-in or snapin connections, and the pump being mountable on the base plate with at least one control unit or vacuum controller fastenable to the base plate.

Such a pump stand offers, inter alia, numerous possibilities for variation of the accessory units usable there, while the pump remains simple and straightforward in design, is easy to clean and can also have a visually pleasing appearance. The versatility in use of this pump stand is enhanced in that different types of pumps (with different outputs) can be mounted without any significant expense.

Further advantageous enhancements include that the pump stand may additionally have a trap and/or an exhaust vapor condenser, and these accessory units can be simply mounted in a compact arrangement on the pump stand.

Moreover, pumps of different sizes, e.g., such with different outputs, may be mounted on the base plate. The mounting points for pumps of different sizes may, for instance, already be provided in the base plate and/or in a plate connected thereto.

Further, the base plate and/or a plate connected thereto may be provided with a holding arm or a holding plate. The vacuum controller and/or trap and/or further attachments for the pump stand can then be mounted on this holding arm or the like.

The control unit or the like can also be mounted with the aid of widening plates—described below—of varying width at different distances from the pump itself.

A particularly important feature of the invention is that the pump and/or the desired accessory units, such as control unit, vacuum controller, trap, etc., can be mounted on the pump stand and removed again, and possibly replaced by other accessory units, comparatively simply and easily by push-in or snap-in connections. If the pump is exchanged, e.g., for one with a larger case, the widening plate for the base plate also allows the necessary room to be made for the larger pump and its control unit next to the pump block.

Still further, at least some of the control and connecting lines, particularly the electric lines, can be accommodated in cavities of the base plate and/or of a plate connected thereto and/or of the holding arm or the like. At least some of the pneumatic connections, that is the usual tubes, ducts and the like, can be accommodated in cavities of the base plate and/or of a plate connected thereto and/or in the holding arm or the lie. Both above-mentioned groups of features provide not only a protection for the pneumatic and electrical connections, but also reduce the expense for assembly of the pump stand, because the connecting lines no longer need to be fixed individually to the supporting plate but can be simply placed in the cavities. These features also facilitate cleaning the pump stand and giving it a pleasing appearance.

In addition, all electrical components belonging to the pump stand can be connected simply and reliably to the main electrical supply by means of a single, central main connection. If individual items of equipment of the pump stand have an operating voltage differing from the main voltage, there is the possibility of integrating transformers, power supply units or the like into the pump stand, in order that these items of equipment can also be supplied with electrical energy through the central main connection.

BRIEF DESCRIPTION OF THE DRAWINGS

The foregoing summary, as well as the following detailed description of preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. The individual features may be realized singly or severally in an embodiment of the invention. In the drawings.

DETAILED DESCRIPTION OF PREFERRED EMBODIMENTS

Figure 1:
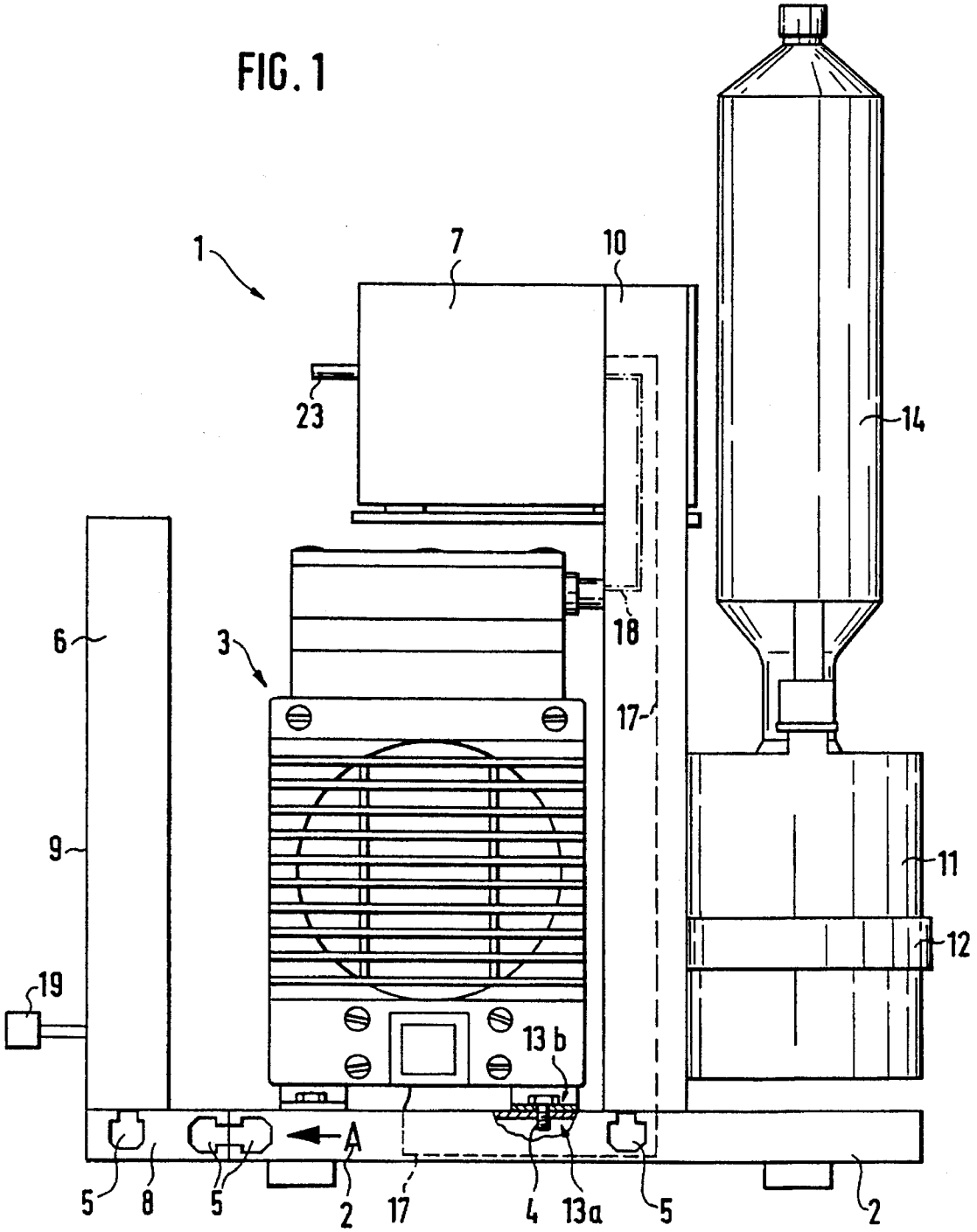
FIG. 1 is a partly sectional, schematic side view of a pump stand according to the invention with a pump and related components mounted thereon.

A pump stand 1 has a base plate 2 onto which the pump 3 is mounted with the aid of screw fittings 4. The base plate 2 has push-in or snap-in connections 5, hereinafter also referred to in short as "push-in connections 5". Such push-in connections 5 are known in the art in various forms and are preferably of a type which allows the pump and/or accessory units to be detachably connected to the stand. A control unit 6 and a vacuum controller 7 are mounted on the base plate 2.

Figure 2:
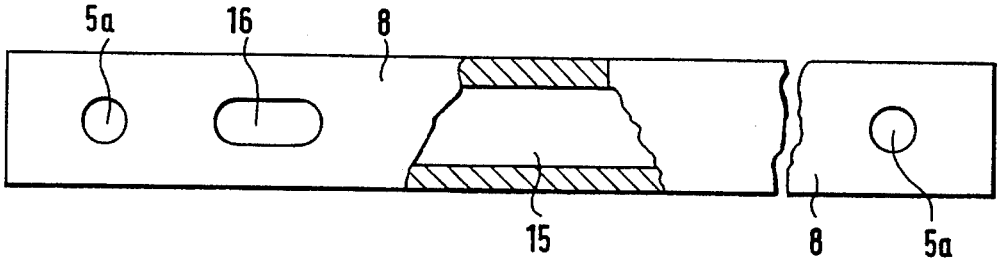
FIG. 2 is a partly sectional, longitudinal side view of a widening plate according to the invention taken in the direction of arrow A in FIG. 1.

A widening plate 8 is detachably fitted by push-in connections 5 to the lefthand narrow edge of the base plate 2 and is depicted more clearly in FIG. 2. The widening plate 8 carries the casing 9 of the control unit 6, the connection between the casing 9 and the widening plate 8 again being established by a push-in connection 5. For example, widening plates 8 of varying width can be fitted to base plate 2. Thus, in a simple way, sufficient space can be created so that pumps 3 taking up more room can be accommodated well on the supporting plate composed of the base plate 2 and widening plate 8.

Accordingly, the pump 3 can also be replaced on the base plate 2, for instance by one of larger cross-section, without involving the significant expense otherwise incurred. Various locating or mounting points 13*a* are provided for this purpose on the base plate 2 and can be connected to corresponding locating or mounting points 13*b* of the respective pump 3 required. In FIG. 1, such a mounting point is shown in section, the screw fitting 4 being formed by a mounting point 13*a* taking the form of a tapped hole in the base plate 2, and receiving a screw placed in the mounting point 13*b*.

In FIG. 1, on the right next to the pump 3, there is a holding arm 10 or the like, again mounted on the base plate 2 by a push-in connection 5. This holding arm 10 may also take the form of a triangular holding plate. At its upper end the holding arm 10 carries the vacuum controller 7. In its lower area the holding arm 10 carries a separator or trap 11, e.g., a corresponding vessel fastened on holding arm 10 by means of a holding strap 12. In FIG. 1, behind the trap 11 and connected to the holding arm 10, is an exhaust vapor condenser 14. The control unit 6 and the holding arm 10 are detachably connected to the base plate and widening plate 8 thereof through the push-in connections 5.

The desired accessory units, such as the control unit 6, the vacuum controller 7, the trap 11 and/or the exhaust vapor condenser 14 can be mounted on the pump stand 1 and removed again, and possibly be replaced by other accessory units, in a comparatively simple manner.

FIG. 2 illustrates a longitudinal side view of the widening plate 8 viewed from direction A in FIG. 1, showing the holes 5*a* belonging to the push-in connections 5 and a cavity 15 and openings 16 in the wall. In cross-section the widening plate may take the form of, for example, a hollow box section (FIG. 2) or a downwardly open U-section.

In schematic form in FIG. 1 there is shown within the holding arm 10 and the base plate 2 a portion of an electric line 17, indicated by in a dashed line, and a portion of a pneumatic connection 18, indicated by a double dot-dash line, in order to demonstrate that, if necessary, power supply lines, measuring, control or data lines, and similarly also pneumatic connections can be accommodated in the base plate 2, holding arm 10 or the like. These may then pass through wall openings 16 similar to those in the widening plate 8 shown in FIG. 2, e.g., from the latter into the base plate 2. Analogous to the widening plate 8, the base plate 2 and the holding arm 10 may be designed for receiving and passing through electric lines and/or pneumatic connections, e.g., tubes. The pump stand 1 may further have a single, central main connection 19 through which all the electrical components belonging to the pump stand can be connected to the electric supply main. By this means, connecting the pump stand 1 to the main is made considerably easier, and the operational reliability of the pump stand 1 is increased.

Figure 3:
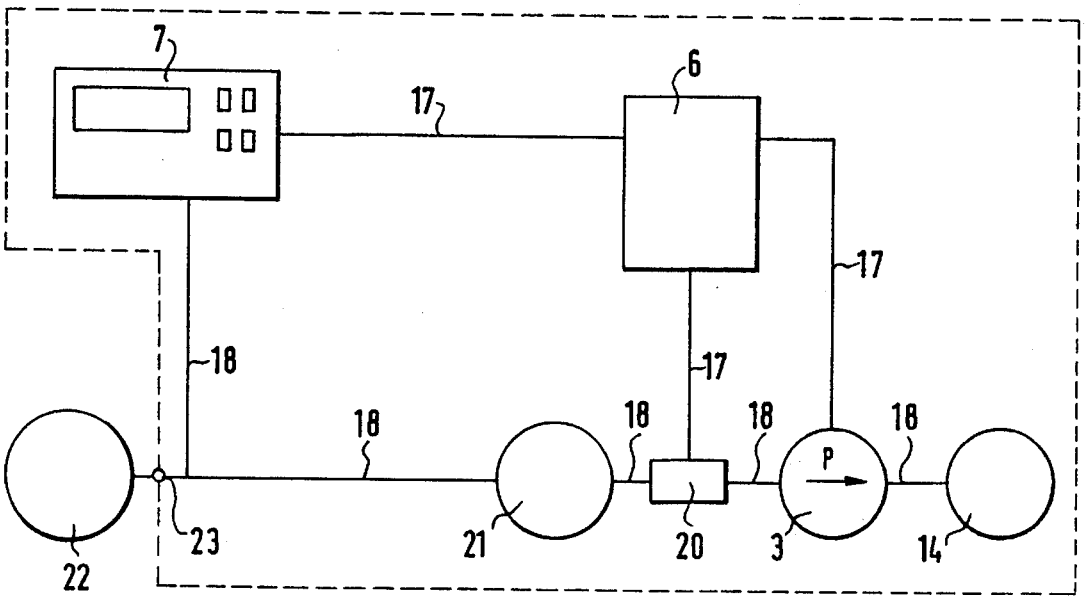
FIG. 3 is a circuit diagram for the pump stand components according to FIG. 1.

FIG. 3 shows in schematic form the electric and pneumatic circuitry for the pump stand 1, electric connections being designated by the reference number 17 and pneumatic connections by the reference number 18. The pump 3 is connected on its inlet side to a combined vacuum/check valve 20 with pump ventilation, in series with a trap 21 connected via the pneumatic connection 23 leading out of the pump stand 1 for connection with the receiver 22 situated outside the pump stand 1. The trap 21 is not absolutely necessary for operation of the pump stand 1 and can be dispensed with, if need be. The vacuum controller 7 is pneumatically connected to the receiver 22 and monitors its pressure.

A hysteresis loop is provided wherein the pump 3 is switched on when an upper pressure setpoint is exceeded and is switched off when a lower pressure setpoint is fallen short of. For transfer of the control information necessary for this, the vacuum controller 7 is electrically connected to the control unit 6 which controls the pump 3 and the vacuum-check valve 20 accordingly. The pump 3 and the control unit 6 are replaceable and can be replaced by another unit desired for a particular application. If required, an exhaust vapor condenser 14 can also be connected to the pump.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A pump stand for a pump, comprising a supporting plate for mounting thereon a pump and at least one accessory unit, said supporting plate comprising a base plate (2) provided with a plurality of push-in connections (5) for fastening at least one of a control unit (6) and a vacuum controller (7) to the base plate (2) and a holding arm (10) connectable to said base plate (2) by push-in connections, for fastening at least one of a trap (11) and an exhaust vapor condenser (14) to the base plate.

2. A pump stand as claimed in claim 1, comprising means for mounting pumps (3) of different sizes on the base plate (2).

3. A pump stand as claimed in claim 2, wherein said mounting means comprises mounting points (13*a*) provided in said base plate (2) for alignment with corresponding mounting points (13*b*) on a pump (3) to be mounted.

4. A pump stand as claimed in claim 1, wherein a pump (3) and at least one of a control unit (6) and a vacuum controller (7) are detachably connectably to the base plate (2) through said push-in connections (5).

5. A pump stand as claimed in claim 1, further comprising a single, central main connection (19) for electric supply to a pump to be mounted on said base plate.

6. A pump stand for a pump, comprising a supporting plate mounting thereon a pump and at least one accessory unit, said supporting plate comprising a base plater (2) provided with a plurality of push-in connections (5) for fastening at least one of a control unit (6) and a vacuum controller (7) to the base plate (2), the supporting plate further comprising at least one widening plate (8) connectable to said base plate (2).

7. A pump stand as claimed in claim 6, wherein said at least one widening plate (8) is connectable to said base plate by push-in connections (5).

8. A pump stand for a pump, comprising a supporting plate mounting thereon a pump and at least one accessory unit, said supporting plate comprising a base plate (2) provided with a plurality of push-in connections (5) for fastening at least one of a control unit (6) and a vacuum controller (7) to the base plate (2), and at least one cavity in said base plate (2) for receiving therein at least one of electric control lines and pneumatic connections for a pump to be mounted on the base plate.

9. A pump stand as claimed in claim 8, further comprising at least one of a widening plate (8) and a holding arm (10) each having at least one cavity therein for receiving therein at least one of electric control lines pneumatic connections for a pump to be mounted on the base plate.

10. A pump stand as claimed in claim 9, further comprising at least one opening (16) in said base plate (2) for passing through at least one of electric control lines and pneumatic connections (18) to at least one of said widening plate (8) and holding arm (10).

* * * * *